US007961151B2

(12) United States Patent
Wang et al.

(10) Patent No.: US 7,961,151 B2
(45) Date of Patent: Jun. 14, 2011

(54) ANTENNAS FOR COMPACT PORTABLE WIRELESS DEVICES

(75) Inventors: Shu-Li Wang, Santa Clara, CA (US); Juan Zavala, Watsonville, CA (US); Christopher David Prest, Mountain View, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 12/577,102

(22) Filed: Oct. 9, 2009

(65) Prior Publication Data

US 2010/0026587 A1 Feb. 4, 2010

Related U.S. Application Data

(62) Division of application No. 11/639,882, filed on Dec. 15, 2006, now Pat. No. 7,623,077.

(51) Int. Cl.
*H01Q 1/24* (2006.01)

(52) U.S. Cl. ..... 343/702; 343/700 MS

(58) Field of Classification Search ..... 343/700, 343/702, 829, 846, 830
See application file for complete search history.

(56) References Cited

U.S. PATENT DOCUMENTS

| | | | | |
|---|---|---|---|---|
| 6,028,555 | A | 2/2000 | Harano | |
| 6,268,831 | B1 | 7/2001 | Sanford | |
| 6,326,921 | B1 | 12/2001 | Egorov et al. | |
| 6,788,200 | B1 * | 9/2004 | Jamel et al. | 340/539.13 |
| 6,788,257 | B2 * | 9/2004 | Fang et al. | 343/700 MS |
| 6,850,196 | B2 | 2/2005 | Wong et al. | |
| 6,943,733 | B2 | 9/2005 | Vance | |
| 7,607,243 | B2 * | 10/2009 | Berner et al. | 36/136 |
| 7,623,078 | B2 * | 11/2009 | Wang | 343/702 |
| 7,758,523 | B2 * | 7/2010 | Collings et al. | 600/592 |
| 2001/0048391 | A1 | 12/2001 | Annamaa et al. | |
| 2002/0019247 | A1 | 2/2002 | Egorov | |
| 2003/0009308 | A1 * | 1/2003 | Kirtley | 702/141 |
| 2003/0122718 | A1 * | 7/2003 | Fang et al. | 343/702 |
| 2004/0041733 | A1 | 3/2004 | Milosavljevic | |
| 2004/0207559 | A1 | 10/2004 | Milosavljevic | |
| 2005/0024272 | A1 | 2/2005 | Ponce De Leon et al. | |
| 2006/0109182 | A1 | 5/2006 | Rosenberg et al. | |
| 2006/0176226 | A1 | 8/2006 | Moon et al. | |

OTHER PUBLICATIONS

H. Nakano et al. "Low-profile inverted-F antenna with parasitic elements on an infinite ground plane", IEE Proc.-Microw. Antennas Propag., vol. 145, No. 4, Aug. 1998, pp. 321-325.

* cited by examiner

*Primary Examiner* — Tho G Phan
(74) *Attorney, Agent, or Firm* — Treyz Law Group; G. Victor Treyz; David C. Kellogg

(57) ABSTRACT

Compact portable wireless devices and antennas for compact portable wireless devices are provided. The compact portable wireless device may be part of a piece of sports equipment. A compact portable wireless device may include a transceiver module that is used in communicating with equipment such as a handheld electronic device. An antenna for a compact portable wireless device can have a relatively small size while exhibiting high efficiency. A planar ground structure for the antenna may be formed from a circuit board on which integrated circuits have been mounted. A curved inverted-F resonating element may be attached to the ground structure. A battery may be provided to power the compact portable wireless device. The battery may be used as a parasitic antenna element.

7 Claims, 13 Drawing Sheets

ANTENNAS FOR COMPACT PORTABLE WIRELESS DEVICES

This application is a division of patent application Ser. No. 11/639,882, filed Dec. 15, 2006, now U.S. Pat. No. 7,623,077 which is hereby incorporated by reference herein in its entirety.

BACKGROUND

This invention relates generally to antennas, and more particularly, to antennas in compact portable wireless devices.

As integrated circuit technology advances, it is becoming feasible to construct portable wireless devices with small form factors. Examples of compact portable wireless devices include mobile telephones, wireless headsets, digital cameras with wireless capabilities, remote controls, wristwatch-type devices, music players with wireless functions, and handheld computers. Devices such as these are often small enough to be held in the hand and may sometimes be referred to as handheld electronic devices.

Compact portable wireless devices use antennas to transmit and receive radio-frequency signals. For example, handheld computers often contain short-range antennas for handling wireless connections with wireless access points.

It is generally desirable for an antenna for a compact portable wireless device to exhibit a high efficiency. Antennas with high efficiencies are less likely to consume excessive power than inefficient antennas and are therefore able to operate using smaller power supplies. In some environments, it is desirable for the antenna in a compact portable wireless device to exhibit a wide bandwidth.

These design goals are challenging in situations in which space is at a premium. It is therefore often difficult or impossible to construct an antenna for a compact portable wireless device that meets efficiency and bandwidth targets.

It would therefore be desirable to be able to provide improved antennas for compact portable wireless devices and improved compact portable wireless devices that use such antennas.

SUMMARY

In accordance with the present invention, a compact portable wireless device and an antenna for a compact portable wireless device are provided. The compact portable wireless device may be used in a system in which the compact portable wireless device communicates wirelessly with external equipment such as a handheld electronic device. The compact portable wireless device may, for example, communicate wirelessly with a music player or handheld computer.

The compact portable wireless device may be mounted within a piece of athletic equipment such as a running shoe. The compact portable wireless device may contain a sensor that senses footsteps taken by a runner. Data from the sensor may be uploaded to a server.

The compact portable wireless device may be oval in shape. A housing for the compact portable wireless device may be formed from two plastic portions. A printed circuit board may be mounted within the housing. The printed circuit board may be mounted in one end of the oval housing. The edge of the circuit board that is nearest to the housing wall may be curved to conform to the oval shape of the housing. A disc battery may be located at the other end of the housing.

A planar ground structure may be formed from the printed circuit board. With one suitable arrangement, the printed circuit board contains multiple layers. Some of the layers in the circuit board contain interconnects that are used for interconnecting integrated circuits and other electrical components that are mounted to the circuit board. At least one layer of the printed circuit board contains metal that is patterned to form a planar antenna ground structure.

The printed circuit board and the battery may be separated by a gap. The battery may have a conductive housing that allows the battery to serve as a parasitic antenna element.

An antenna resonating element is mounted to the circuit board. The resonating element may have an F shape. The resonating element may have a main structure that is formed from a curved strip of metal. The resonating element may also have a feed arm and a ground arm. The feed arm and ground arm are connected to the printed circuit board. The ground arm is electrically connected to the planar ground structure. The feed arm and ground arm are perpendicular to the printed circuit board.

Further features of the invention, its nature and various advantages will be more apparent from the accompanying drawings and the following detailed description of the preferred embodiments.

DETAILED DESCRIPTION

Figure 1:
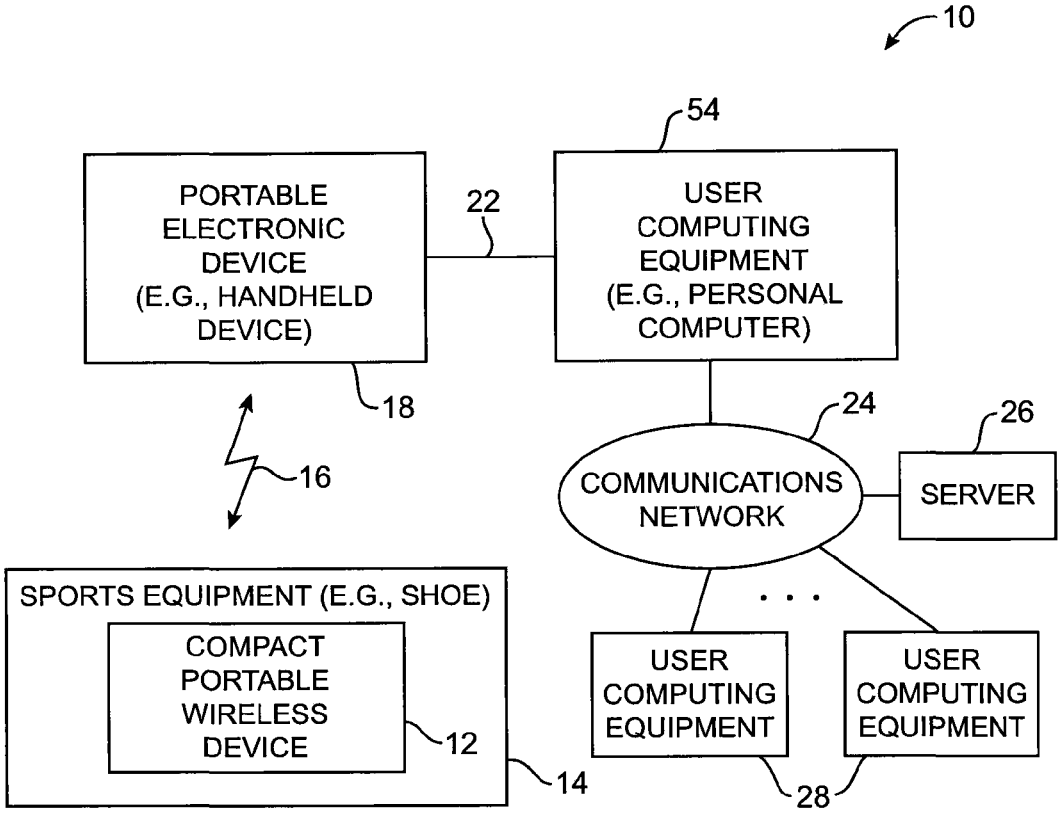
FIG. 1 is a schematic diagram of an illustrative system including a compact portable wireless device with an antenna in accordance with an embodiment of the present invention.

An illustrative system that contains a compact portable wireless device in accordance with an embodiment the present invention is shown in FIG. 1. As shown in FIG. 1, compact portable wireless device 12 in system 10 may communicate with other devices over wireless communications path 16. Compact portable wireless device 12 may contain an antenna that exhibits a high efficiency and wide bandwidth in a small form factor. Use of this type of antenna is particularly advantageous in compact portable wireless devices where small size and good power efficiency are desired.

A high efficiency and wide bandwidth antenna in accordance with the present invention can be used in any suitable wireless electronic device, including personal computers, portable computers, handheld devices, etc. Suitable handheld devices that may use this type of antenna may include cellular telephones, media players with wireless communications capabilities, handheld computers (also sometimes called personal digital assistants), remote controllers, global positioning system (GPS) devices, handheld gaming devices, and hybrid devices that combine the functionality of multiple conventional devices. Examples of hybrid handheld devices include a cellular telephone that includes media player functionality, a gaming device that includes a wireless communications capability, a cellular telephone that includes game and email functions, and a handheld device that receives email, supports mobile telephone calls, and supports web browsing.

Although high efficiency and wide bandwidth antennas in accordance with the present invention may be used in any suitable wireless device, it can be particularly advantageous to use a small form-factor antenna that exhibits high efficiency and wide bandwidth in a compact portable wireless device. Space is at a premium in compact portable wireless devices, so antennas that have a small form factor are often used to reduce device volume. Moreover, compact portable wireless devices often use small batteries, which can increase the desirability of power-efficient antenna designs. Antennas in accordance with the invention are therefore often described herein in the context of compact portable wireless devices, such as compact portable wireless device 12 of FIG. 1.

Compact portable wireless devices, such as compact portable device 12 of FIG. 1, may be wrist devices, pendant devices, headphone and earpiece devices, and other wearable and miniature devices. As shown in FIG. 1, compact portable wireless device 12 may be used in an item of sports equipment 14. With one particularly suitable arrangement, compact portable wireless device 12 is a wireless pedometer module that is installed in the sole of a running shoe. Once installed in the running shoe, the module can wirelessly communicate with external equipment. The compact portable wireless device may, as an example, gather information on how many steps a runner is taking and may transmit this information to a handheld device for processing.

In the example of FIG. 1, compact portable wireless device 12 may communicate with portable electronic device 18 over wireless communications path 16. Wireless communications path 16 may be a Bluetooth communications path, an IEEE 802.11 wireless communications path (i.e., a WiFi path), a communications path using a custom wireless protocol, or any other suitable wireless communications path. The frequency range covered by path 16 may be about 2.4-2.7 GHz. This is merely illustrative. Path 16 may use any suitable communications band if desired.

Portable electronic device 18 may be a small portable computer such as the type of computer that is sometimes referred to as an ultraportable. Portable electronic device 18 device may also be a smaller device such as a wrist device, a pendant devices, a headphone or earpiece device, another wearable or miniature device. With one suitable arrangement, portable electronic device 18 is a handheld electronic device. Compact portable wireless device 12 is therefore sometimes described as being used with a handheld electronic device as an example.

Handheld electronic device 18 may be, for example, a cellular telephone, a media player with integrated wireless communications capabilities or with wireless communications capabilities that are provided using a plug-in wireless adapter, a handheld computer (personal digital assistant), a remote controller, a global positioning system (GPS) device, a handheld gaming device, or a hybrid device that combines the functionality of two or more such devices. For example, handheld device 18 may be a hybrid device formed by combining music player and cellular telephone functionality.

Electronic device 18 may communicate with additional electronic equipment. As shown in FIG. 1, electronic device 18 may communicate with user computing equipment 54 over communications link 22. User computing equipment 54 may be any suitable computing equipment including a personal computer, a laptop computer, a handheld computer, a mainframe computer, a workstation, equipment that contains embedded processors, etc. With one suitable arrangement, user computing equipment 54 is a personal computer that has a port that receives portable electronic device 18. The port may be, as an example, a universal serial bus port or a dedicated port built into a docking station. When portable electronic device 18 is connected to the port, portable electronic device 18 may gather data from compact portable wireless device 12 and may transfer this data to user computing equipment 54 over communications path 22.

User computing equipment 54 may be connected to server 26 and other user computing equipment 28 over a communications network 24. Communications network 24 may include local area networks, wide area networks such as the internet, or any other suitable communications networks. Server 26 may be implemented using one or more computers at one or more geographic locations. Server 26 may be used to implement a collaborative service that supports athletes or other users who each have a respective compact portable wireless device. As an example, server 26 may be used to implement a service in which runners can track their training progress and can compete in virtual competitions with other runners. Compact portable wireless device 12 may be used to gather training data and data for virtual races. During a runner's training run or race, portable electronic device 18 may wirelessly gather data that is captured using a sensor in compact portable wireless device 12. After the training run or race is complete, the captured data may be downloaded to user computing equipment 54 over communications path 22.

Once the data has been downloaded to user computing equipment 54, a user can use an application running on user computing equipment 54 to process the data (e.g., to track the use's training progress, to compute running speeds throughout a particular run, to compare the data against historical data, etc.). The user can also upload the data from user computing equipment 54 to server 26. Server 26 can use the data that has been uploaded from multiple users. For example, server 26 can compare the performance of two or more runners to determine which runner has won a virtual race. So long as these runners are able to upload the data from their compact portable wireless devices to server 26, server 26 can compare their performance. It is not necessary for the runners to share the same physical location.

Figure 2:
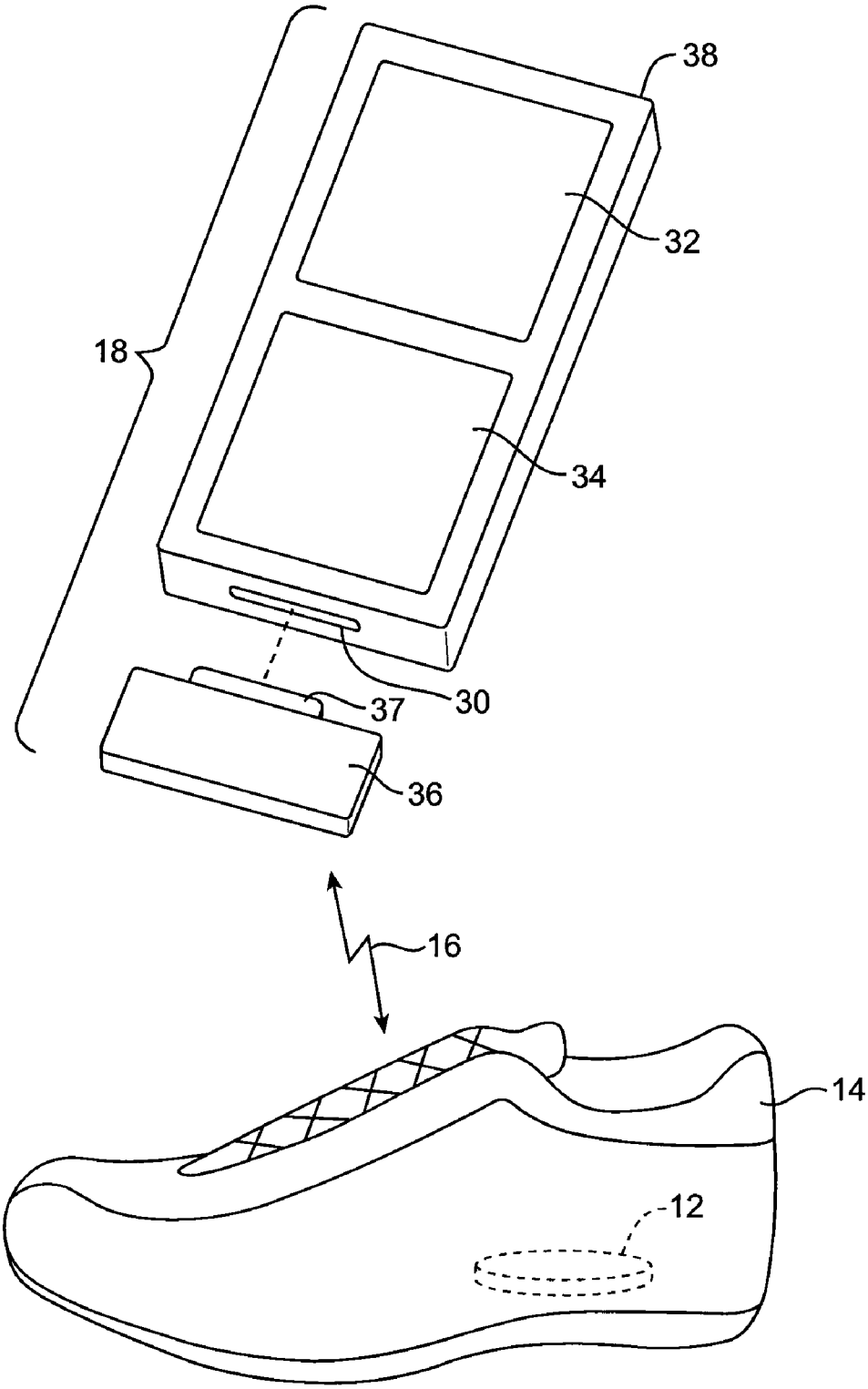
FIG. 2 is a perspective view of an illustrative handheld electronic device in communication with a compact portable wireless device that has been installed in a running shoe in accordance with an embodiment of the present invention.

FIG. 2 is a perspective view of an illustrative handheld electronic device in communication with an illustrative compact portable wireless device. In the example of FIG. 2, handheld electronic device 18 has main unit 38 and wireless adapter 36. Main unit 38 (which is sometimes referred to as a handheld electronic device) may be, for example, a music player, a handheld computer, a cellular telephone, etc.

Main unit 38 of device 18 may have input-output devices such as a display screen 32, user input-output controls 34, and input-output port 30. Display screen 32 may be, for example, a liquid crystal display (LCD), an organic light-emitting diode (OLED) display, a plasma display, or multiple displays that use one or more different display technologies. As shown in the example of FIG. 2, display screens such as display screen 32 can be mounted on a front face of the handheld electronic device. If desired, displays such as display 32 can be mounted on the rear face of the handheld electronic device or on a side or other portion of the device of the device. Visual indicators such as light-emitting diodes (LEDs) may be used instead of or in conjunction with screen 32 to provide visual status information to a user.

A user of handheld device 18 may supply input commands using user input interface 34. User input interface 34 may include buttons (e.g., alphanumeric keys, power on-off, power-on, power-off, and other specialized buttons, etc.), a touch pad, pointing stick, or other cursor control device, a touch screen (e.g., a touch screen implemented as part of screen 32), or any other suitable interface for controlling device 18. Although shown schematically as being formed on the top face of main unit 38 of handheld electronic device 18 in the example of FIG. 2, user input interface 34 may generally be formed on any suitable portion of handheld electronic device 18. For example, a button or other user interface control may be formed on the side of main unit 38 or on adapter 36. If desired, device 18 can be controlled remotely (e.g., using an infrared remote control, a radio-frequency remote control such as a Bluetooth remote control, etc.).

Handheld device 18 may have ports such as port 30. Port 30 may be, as an example, a 30-pin female electrical connector that mates with corresponding 30-pin male electrical connectors (e.g., connectors on cables, docking stations, etc.). As shown in FIG. 2, adapter 36 has male connector 37, which mates with port 30. When adapter 36 is inserted into port 30, adapter 36 can be used to provide wireless transmit and receive functions for device 18. Adapter 36 may include an antenna and radio-frequency transceiver circuitry that allow adapter 36 to communicate with compact portable wireless device 12 over communications path 16. Adapter 36 may also include communications circuitry that supports communications between adapter 36 and main unit 38. If desired, the functions of wireless adapter 36 may be incorporated into main unit 38. In integrated configurations, main unit 38 contains an antenna and radio-frequency transceiver circuitry for communicating with compact wireless device 12 over wireless communications link 16.

In the example of FIG. 2, compact wireless device 12 has been installed in a running shoe 14. Compact portable wireless device 12 may be manufactured as part of shoe 14 (or other suitable athletic equipment) or may be installed by a user. A user may, for example, install compact portable wireless device 12 in shoe 14 by lifting the insole of shoe 14 and placing compact portable wireless device 12 in a recess formed within the sole of shoe 14 under the insole. In situations in which compact portable wireless device 12 is being installed in shoe 14, it can be particularly advantageous to ensure that compact portable wireless device 12 is not too large. Using a compact configuration for the antenna in compact portable wireless device 12 helps to ensure that device 12 is sufficiently small in size.

When compact portable wireless device 12 is used in configurations of the type shown in FIG. 2, the radio-frequency environment can change depending on how device 12 is being used. For example, the compact portable wireless device may exhibit significantly different radio-frequency communications properties depending on whether device 12 is installed in a shoe that is being worn by a user or is installed in a shoe that is not being worn. The presence of a user's foot on top of device 12 may change the frequency tuning of the antenna in device 12. Device 12 may therefore operate somewhat differently when it has not yet been installed in a shoe 14 or when a user has removed device 12 from one shoe in preparation for transferring device 12 to another shoe. Because of these variables, it can be particularly advantageous to ensure that the antenna in compact portable wireless device 12 has a suitably wide frequency band of operation. When the antenna in compact portable wireless device 12 exhibits a sufficiently wide bandwidth, detuning of the antenna's frequency due to changes in the operating environment of portable wireless device 12 does not significantly impact the ability of compact portable wireless device 12 to communicate with external equipment such as portable electronic device 18.

Figure 3:
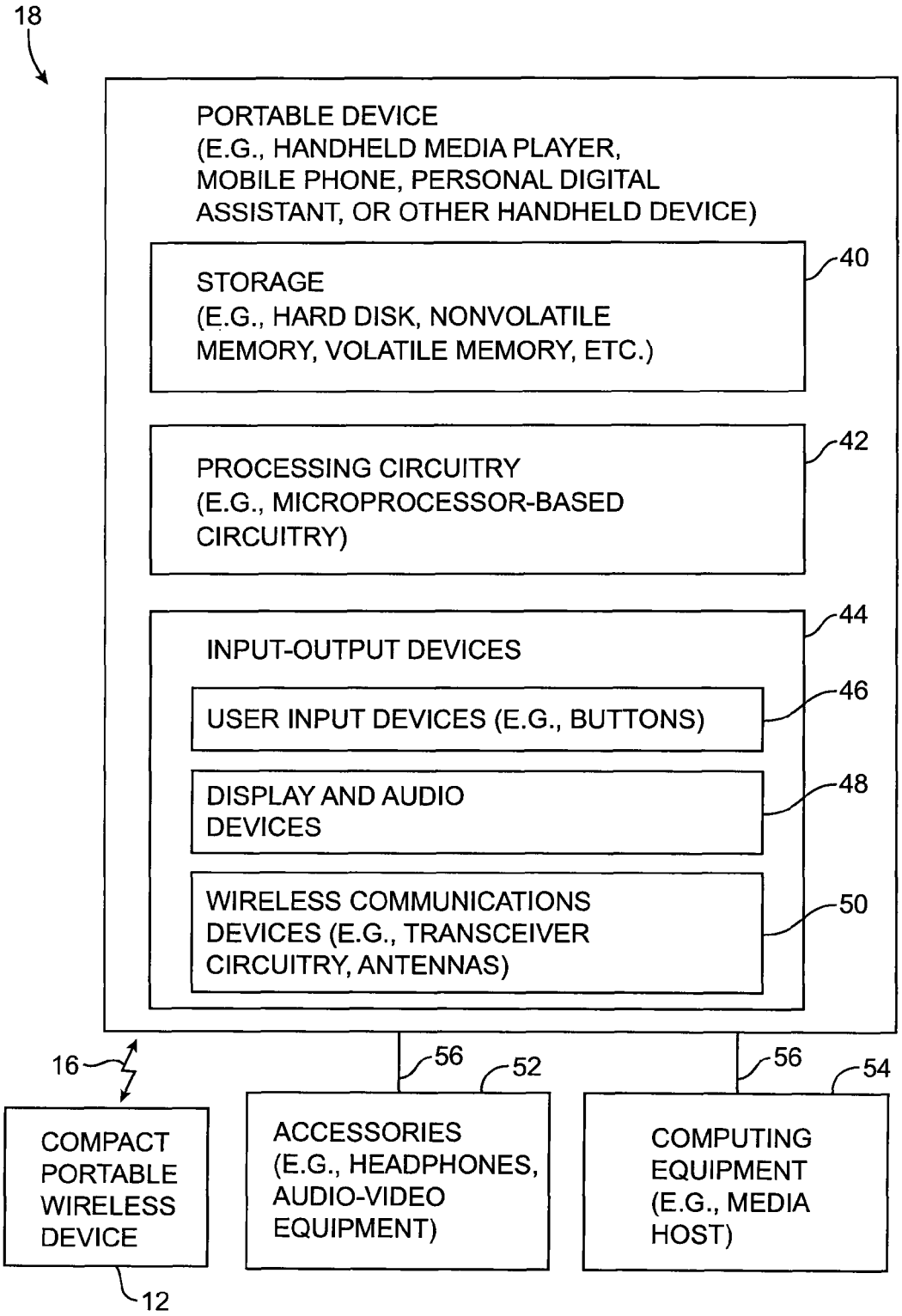
FIG. 3 is a schematic diagram of an illustrative handheld electronic device in communication with a compact portable wireless device, accessories, and computing equipment in accordance with an embodiment of the present invention.

A schematic diagram of handheld electronic device 18 in communication with compact portable wireless device 12 and other devices is shown in FIG. 3. Handheld device 18 may be a mobile telephone, a mobile telephone with media player capabilities, a handheld computer, a remote control, a game player, a global positioning system (GPS) device, a combination of such devices, or any other suitable portable electronic device.

As shown in FIG. 3, handheld device 18 may include storage 40. Storage 40 may include one or more different types of storage such as hard disk drive storage, nonvolatile memory (e.g., flash or other electrically-programmable-read-only memory), volatile memory (e.g., battery-based static or dynamic random-access-memory), etc.

Processing circuitry 42 may be used to control the operation of device 18. Processing circuitry 42 may be based on a processor such as a microprocessor and other suitable integrated circuits.

Input-output devices 44 may allow data to be supplied to device 18 and may allow data to be provided from device 18 to external devices. Input-output devices can include user input-output devices 46 such as buttons, touch screens, joysticks, click wheels, scrolling wheels, touch pads, key pads, keyboards, microphones, cameras, etc. A user can control the operation of device 18 by supplying commands through user input devices 46. Display and audio devices 48 may include liquid-crystal display (LCD) screens, light-emitting diodes (LEDs), and other components that present visual information and status data. Display and audio devices 48 may also include audio equipment such as speakers and other devices for creating sound. Display and audio devices 48 may contain audio-video interface equipment such as jacks for external headphones and monitors.

Wireless communications devices 50 may include communications circuitry such as RF transceiver circuitry formed from one or more integrated circuits, power amplifier circuitry, passive RF components, antennas, and other circuitry for generating RF wireless signals. Wireless signals can also be sent using light (e.g., using infrared communications).

Device 18 can communicate with compact portable wireless device 12 over wireless communications path 16. Device 18 may also communicate with external devices such as accessories 52 and computing equipment 54, as shown by paths 56. Paths 56 may include wired and wireless paths. Accessories 52 may include headphones (e.g., a wireless cellular headset or audio headphones) and audio-video equipment (e.g., wireless speakers, a game controller, or other equipment that receives and plays audio and video content). Computing equipment 54 may be a server from which songs, videos, or other media are downloaded over a cellular telephone link or other wireless link. Computing equipment 54 may also be a local host (e.g., a user's own personal computer), from which the user obtains a wireless download of music or other media files.

Figure 4:
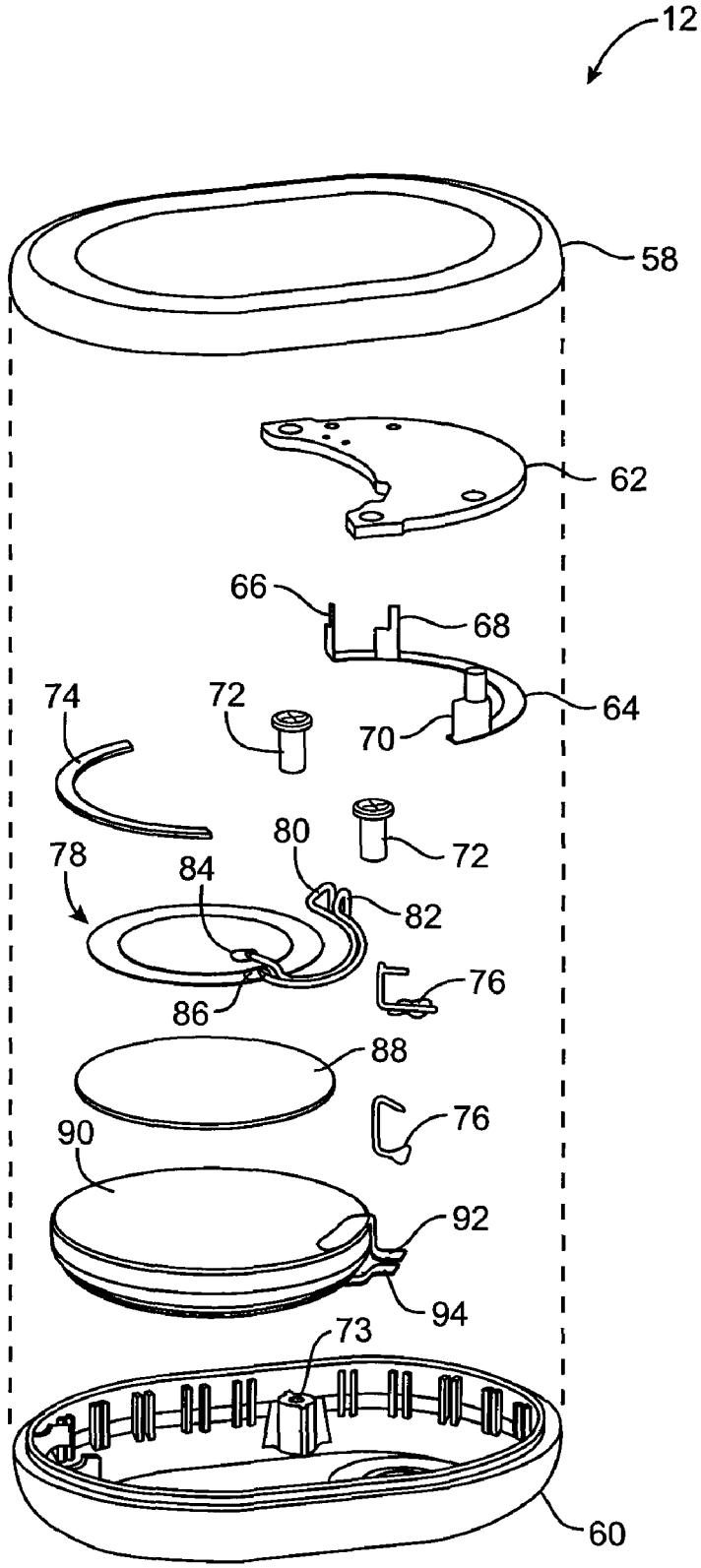
FIG. 4 is an exploded view of an illustrative compact portable wireless device in accordance with an embodiment of the present invention.

An exploded view of an embodiment of compact portable wireless device 12 is shown in FIG. 4. In the example of FIG. 4, compact portable wireless device 12 has a housing formed from first housing portion 58 and second housing portion 60. Housing portions 58 and 60 may be formed of polycarbonate, other plastics, other suitable dielectrics, or other suitable housing materials. At least some of the housing is generally formed of dielectric. With one suitable arrangement, substantially all of the housing of compact portable wireless device 12 may be formed of dielectric, so as not to interfere with the radio-frequency wireless signals being handled by device 12.

A printed circuit board such as printed circuit board 62 may be mounted within the housing formed from housing portion 58 and housing portion 60. The edge of circuit board 62 that is nearest to the edge of housing portions 58 and 60 may be curved to accommodate the curved oval shape of the housing. The other edge of circuit board 62 may be curved to accommodate disc battery 90. Printed circuit board 62 may be formed from a multilayer printed circuit board. Suitable circuit board materials for printed circuit board 62 include paper impregnated with phonolic resin, resins reinforced with glass fibers such as fiberglass mat impregnated with epoxy resin (sometimes referred to as FR-4), plastics, polytetrafluoroethylene, polystyrene, polyimide, and ceramics. Circuit boards fabricated from materials such as FR-4 are commonly available, are not cost-prohibitive, and can be fabricated with multiple layers of metal (e.g., four layers).

With one suitable configuration, at least one of the layers of circuit board 62 is provided with large amounts of metal (e.g., all or most of that layer of the circuit board is patterned to form a planar conductor). With this type of arrangement, circuit board 62 can be used to form a planar ground structure for the antenna.

The antenna for compact portable wireless device 12 may also include a resonating element. In the example of FIG. 4, resonating element 64 has an F-shaped (inverted-F) structure with two legs 66 and 68 and a main structure formed of a curved strip of conductor. Support post 70 supports the main conductive strip portion of resonating element 64. Support post 70 may be formed of plastic or other suitable dielectric materials suitable for providing structural support for resonating element 64. With one suitable arrangement, support post 70 is formed from a plastic based on acrylonitrile-butadiene-styrene copolymers (sometimes referred to as ABS plastic). Post 70 may be formed by injection molding or any other suitable process. During assembly, the tips of legs 66 and 68 and the tip of post 70 may be inserted into mating holes in printed circuit board 62.

Device 12 may include screws 72 (e.g., plastic screws or other fasteners), housing spacer 74, and battery wires 76. A piezoelectric sensor may be used to monitor each step that a user takes (e.g., when a user is running and is using compact portable wireless device 12 to monitor running statistics). In the example of FIG. 4, piezoelectric sensor 78 is connected to wire leads 80 and 82 at respective terminals 84 and 86. Foam disk 88 may be used to provide insulation between piezoelectric sensor 78 and disc-shaped battery 90. If desired, ultraviolet-cured epoxy or other suitable adhesive may be used to fix wires 80 and 82 to a portion of device 12 (e.g., to battery 90 or other stable support structure). Attaching the sensor wires in this way helps to isolate the sensor from movement of the wires and controls the position of the wires. Control of the wire position may result in more consistent antenna performance.

Battery 90 may be any suitable type of battery (e.g., silver oxide, lithium, etc.). Battery 90 preferably has a conductive case such as a metal case formed of stainless steel or aluminum. Battery 90 may be a disc-shaped battery or other suitable low profile battery.

Direct current (DC) electrical contacts may be formed on battery 90 at terminals 92 and 94. Positive and negative power distribution wires (not shown in FIG. 4) are connected to terminals 92 and 94 and are used to route power to printed circuit board 62. During operation, battery 90 forms a planar parasitic antenna element in the antenna of compact portable wireless device 12, due to the conductive nature of the battery case and the proximity of the battery case to the planar ground structure formed from printed circuit board 62. Battery 90 and the ground structure of printed circuit board 62 are co-planar and lie in a common plane (ignoring the small non-zero thickness of the battery).

Figure 5:
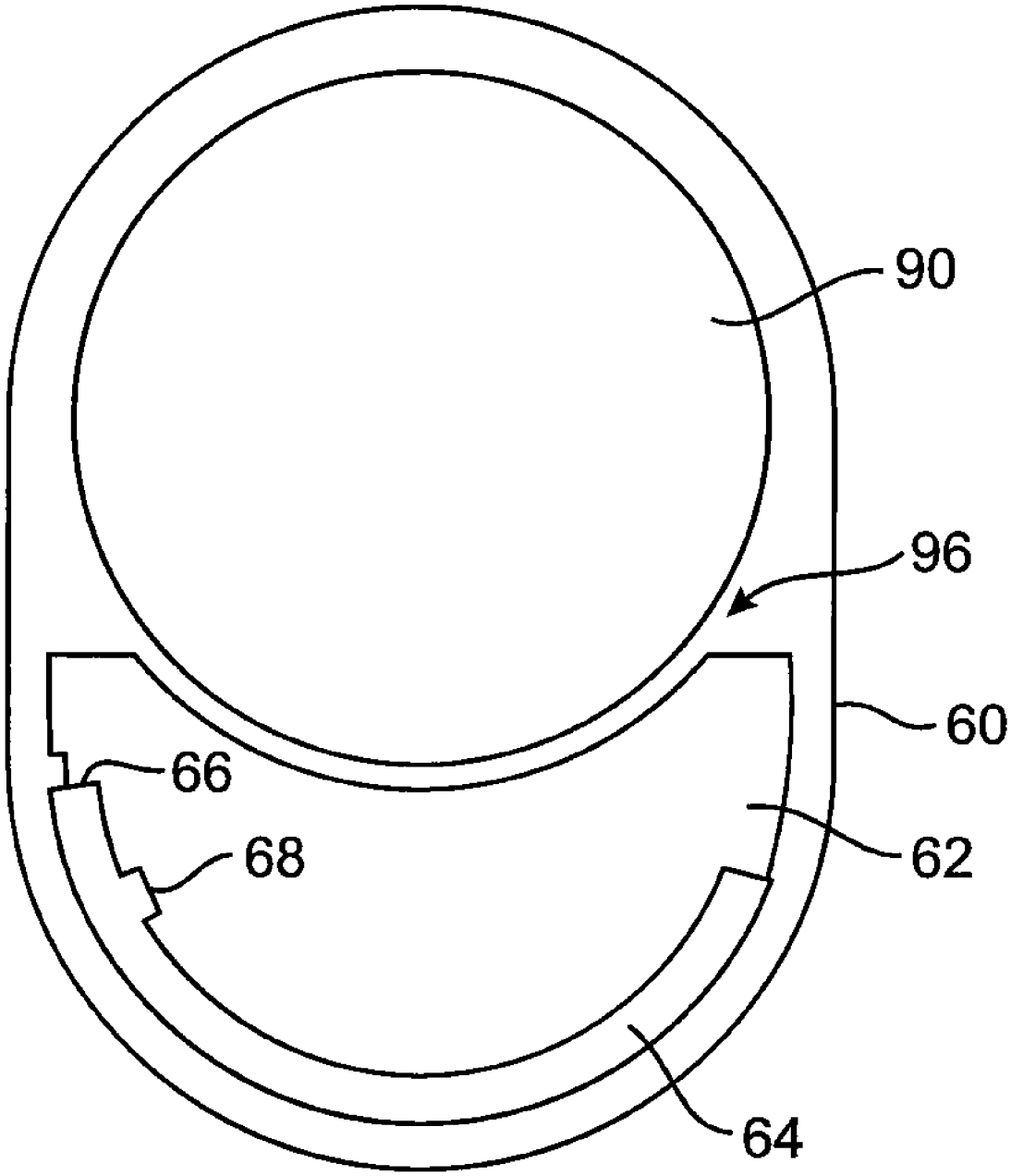
FIG. 5 is a simplified plan view of an interior portion of an illustrative compact portable wireless device in accordance with an embodiment of the present invention.

As shown in the top view of compact portable wireless device 12 in FIG. 5, there is generally an air gap 96 or other dielectric gap 96 between the case of battery 90 and the planar antenna ground structure formed from printed circuit board 62. Despite the presence of gap 96, the conductive case of the battery forms a portion of the antenna, because the conductive case of the battery is coupled to the planar ground structure of board 62 through near-field coupling (i.e., coupling in which electrical and magnetic field interactions induce currents across a dielectric gap). Gap 96 may be, as an example, a 1 mm gap. If desired, other gap dimensions may be used in compact portable wireless device 12. As an example, gap 96 may be in a range of about 0.5 mm to about 2.0 mm or may be as large as 3 mm or more. Excessively large sizes for gap 96 should generally be avoided, however, because overly large gap arrangements reduce radio-frequency near-field coupling efficiency between the battery case parasitic antenna element and the planar ground structure of the printed circuit board.

Figure 6:
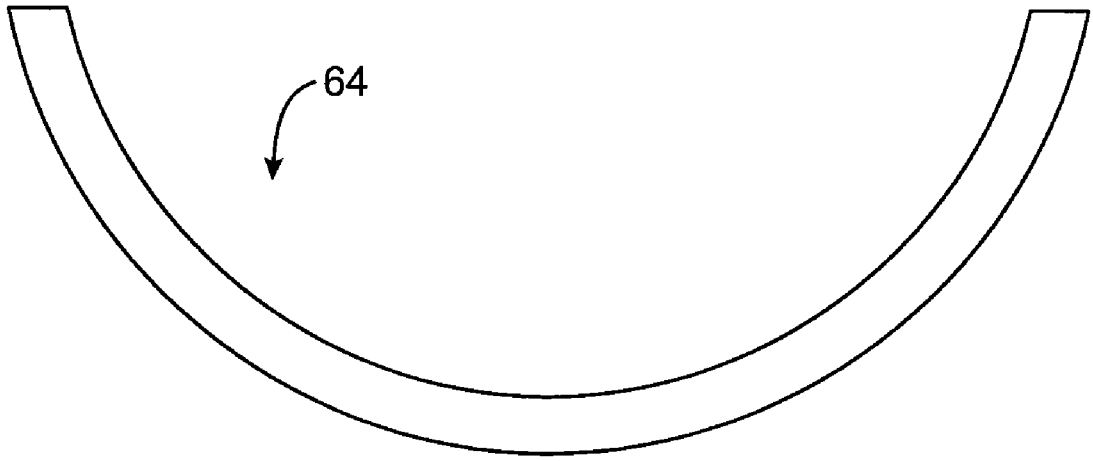
FIG. 6 is a plan view of an illustrative antenna resonating element main structure for a compact portable wireless device in accordance with an embodiment of the present invention.
Figure 7:
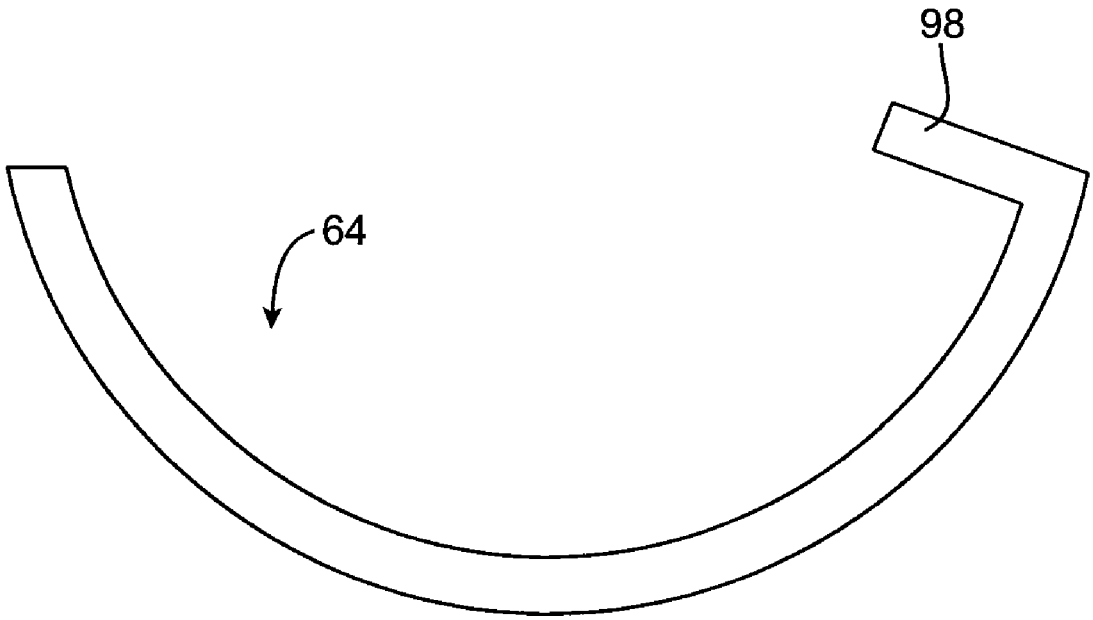
FIG. 7 is a plan view of another illustrative antenna resonating element main structure for a compact portable wireless device in accordance with an embodiment of the present invention.

Resonating element 64 may be any suitable shape. In the example of FIG. 6, resonating element 64 has a main structure that is formed from a narrow semicircular strip of conductor. The conductive material that is used for resonating element 64 depends on considerations such as cost and manufacturability. Examples of suitable conductive materials for antenna resonating element 64 include metals, such as copper, brass, silver, and gold. Conductors other than metals may also be used, if desired. In the example of FIG. 7, resonating element 64 has bent portion 98, which is angled with respect to the otherwise semicircular shape of the resonating element. The configurations of FIGS. 6 and 7 are merely illustrative. Any suitable resonating element configuration may be used. An advantage of the shapes of FIGS. 6 and 7 is that these shapes fit within the confines of the compact portable wireless device housing and provide good lateral spacing between resonating element 64 and components mounted on circuit boards 64, unlike conventional planar inverted-F antennas.

Figure 8:
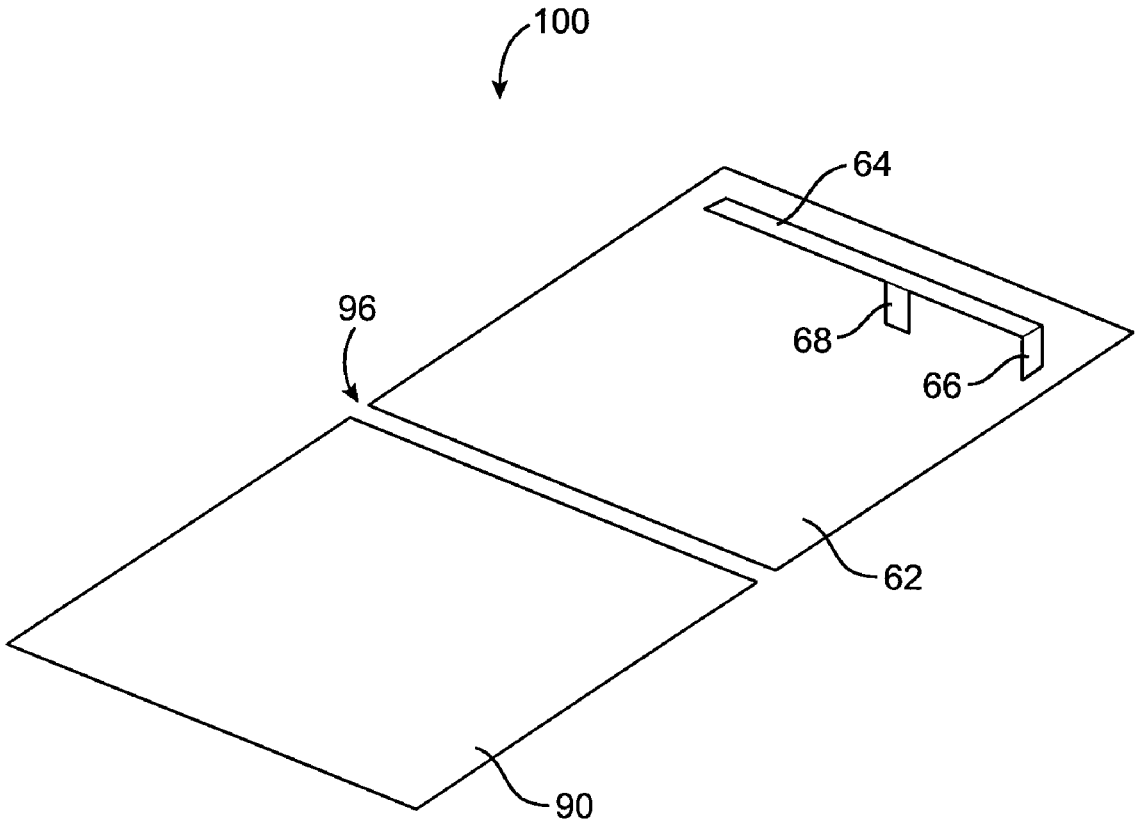
FIG. 8 is a simplified perspective view of an antenna for a compact portable wireless device in accordance with an embodiment of the present invention.

The operative portions of the antenna in compact portable wireless device 12 are shown in the diagram of FIG. 8. As shown in FIG. 8, antenna 100 includes a planar ground structure, which may be formed from printed circuit board 62. Antenna 100 also includes resonating element 64. Parasitic antenna element 90 of antenna 100 may be formed from the case of battery 90. Parasitic antenna element 90 and planar ground structure 62 may be separated by dielectric gap 96 (e.g., air, plastic, etc.).

Resonating element 64 has the general shape of an inverted-F antenna and is sometimes referred to as an inverted-F or F-shaped resonating element. Resonating element 64 has a feed structure formed from leg 68 and a ground structure formed from leg 66. Device 12 contains a transceiver integrated circuit. A positive terminal associated with the transceiver is electrically connected to the antenna feed structure formed by leg 66. A negative terminal associated with the transceiver is electrically connected to the ground structure formed by leg 68. Leg 68 is also electrically connected to the planar ground structure formed from printed circuit board 62. During operation, the transceiver integrated circuit and other circuitry in device 12 transmit and receive wireless signals using antenna 100.

In addition to legs 66 and 68, resonating element 64 has a main strip structure. The main strip-shaped structure of resonating element 64 is shown as being straight in the simplified view of FIG. 8, but is generally shaped to conform to the outermost limits permitted by the size of the housing of compact portable wireless device 12. For example, when the housing for device 12 is oval in shape, the main conductive strip structure of resonating element 64 may have a curved shape that matches the curve of the oval housing and printed circuit board 62. Planar ground structure 62 generally lies directly beneath the curved main structure of resonating element 64 and forms a ground plane for resonating element 64. To ensure that antenna 100 has a small form factor, the height of legs 66 and 68 perpendicular to the plane of ground structure 62 may be on the order of 2.4 mm (e.g., greater than 1 mm and less than 4 mm). This is significantly less than conventional antenna structures, which often have legs of 6 mm or longer.

The selected sizes of the antenna structures in antenna 100 help to ensure that antenna 100 operates over a desired operating frequency range. With one suitable arrangement, the lateral spacing between legs 66 and 68 can be selected to help tune the antenna to a desired operating frequency. In a typical scenario, the lateral spacing between leg 66 and leg 68 is about 2-3 mm when the operating frequency for antenna 100 is about 2.4 GHz. The width of the strip of metal (or other conductor) that is used to form the curved semicircular main structure of resonating element 64 may be (as an example) about 1.5 mm. Widths of about 1.5-2.3 mm may be used (or possibly even widths of 1.0 to 3.0 mm).

Figure 9:
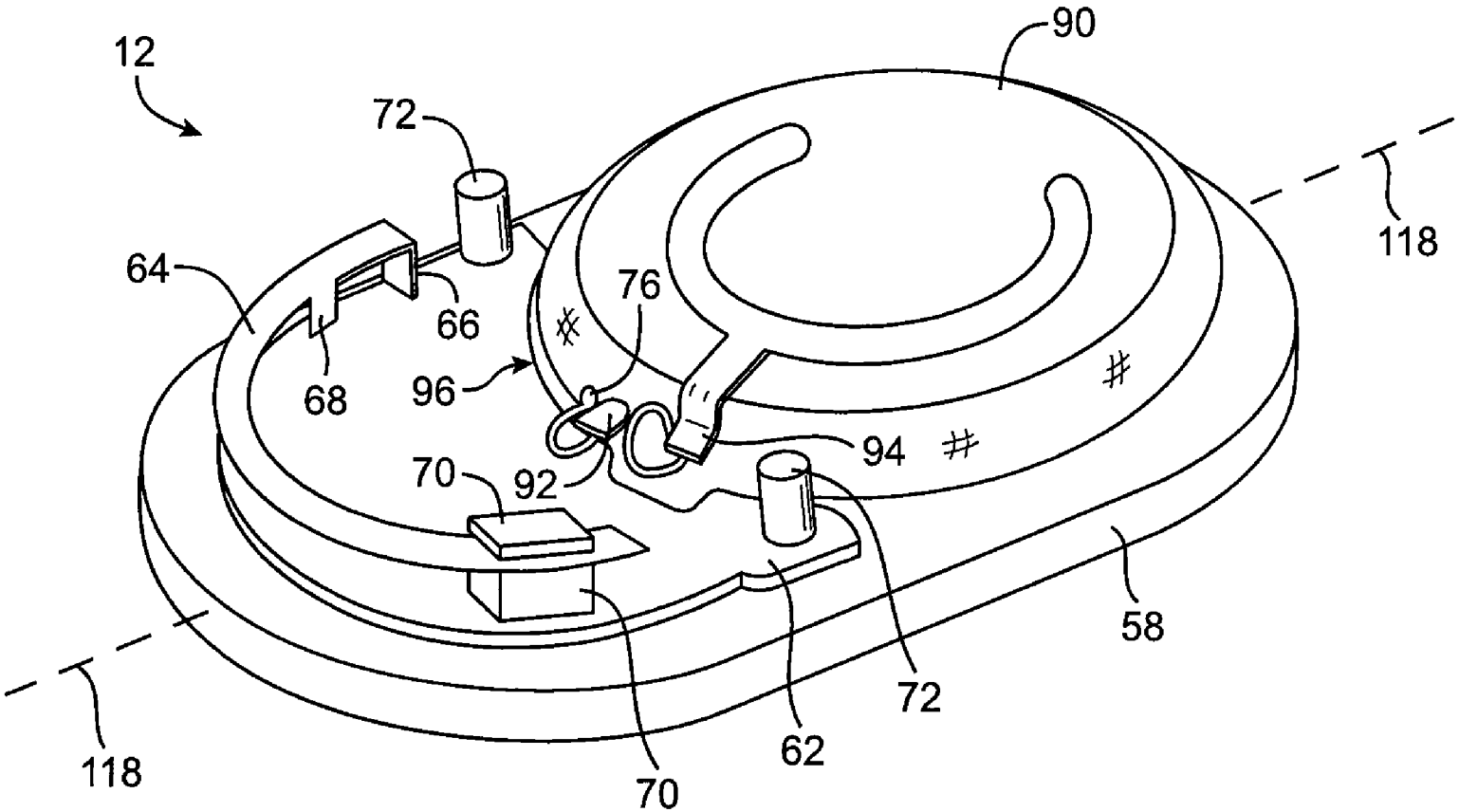
FIG. 9 is a perspective view of a first portion of an illustrative compact portable wireless device in accordance with an embodiment of the present invention.

A perspective view of a portion of illustrative compact portable wireless device 12 is shown in FIG. 9. As shown in FIG. 9, legs 66 and 68 of resonating element 64 may be inserted into mating slots on printed circuit board 62, so that electrical connection may be made between legs 66 and 68 and corresponding conductive traces within printed circuit board 62. One or more support structures such as support post 70 may be used to support resonating element 64. Support structures such as these are typically made of dielectric, so as not to influence the RF properties of resonating element 64.

Screws such as plastic screws 72 may be used to help secure printed circuit board 62 within the housing of compact portable wireless device 12. Screws 72 may screw into mating threaded structures on housing portion 60 such as structure 73 of FIG. 4. Screws 72 are protruding upwardly in the orientation of FIG. 9, so that their threaded ends are exposed.

Battery wires 76 may make electrical contact with positive and negative terminals located on the upper and lower surfaces of battery 90. If desired, battery terminals 92 and 94 may have extensions such as extension 101 in FIG. 9, which help ensure that there is a good ohmic contact between battery wires 76 and battery 90.

In the example of FIG. 9, housing portion 58 has an oval shape. In situations such as the situation of FIG. 9 in which the periphery of housing portion 58 is curved, it can be advantageous to use an antenna resonating element with a curved shape. This helps to place the resonating element in a location in which it is not immediately adjacent to components on printed circuit board 62 and thereby minimizes undesirable radio-frequency interference between the antenna and the integrated circuits and other electrical components on printed circuit board 64. In situations in which the outline of the housing of the compact portable wireless device 12 has a different shape (e.g., a rectangular shape, etc.), the shape of resonating element 64 can be adjusted to accommodate the housing, while maximizing the distance between resonating element 64 and electronic components on board 62 to minimize the potential for radio-frequency interference.

Figure 10:
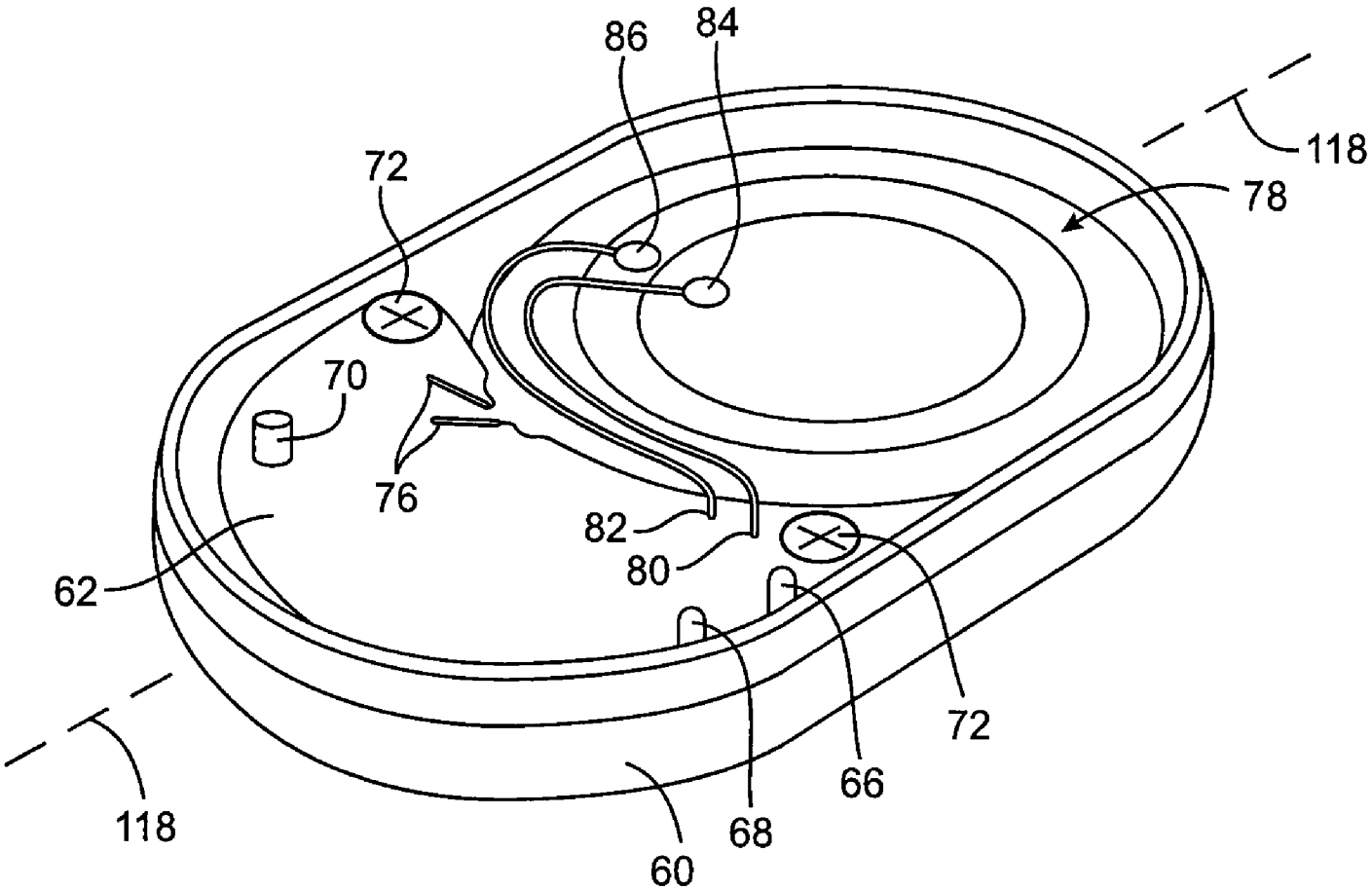
FIG. 10 is a perspective view of a second portion of an illustrative compact portable wireless device in accordance with an embodiment of the present invention.

The illustrative portion of device 12 that is shown in FIG. 9 includes housing portion 58. A perspective view of an illustrative portion of a compact portable wireless device 12 that includes mating housing portion 60 is shown in FIG. 10. As shown in FIG. 10, the tips of legs 66 and 68 of resonating element 64 protrude through printed circuit board 62. Support post 70 may also protrude through board 62. Screws 72 may be used to secure printed circuit board 62 to housing portion 60.

Battery wires 76 and sensor wires 82 and 80 may be soldered to pads on printed circuit board 62 to form an electrical connection with the interconnect structures formed in printed circuit board 62. The tips of legs 66 and 68 may also be electrically connected to the interconnects of board 62 by soldering (as an example).

Figure 11:
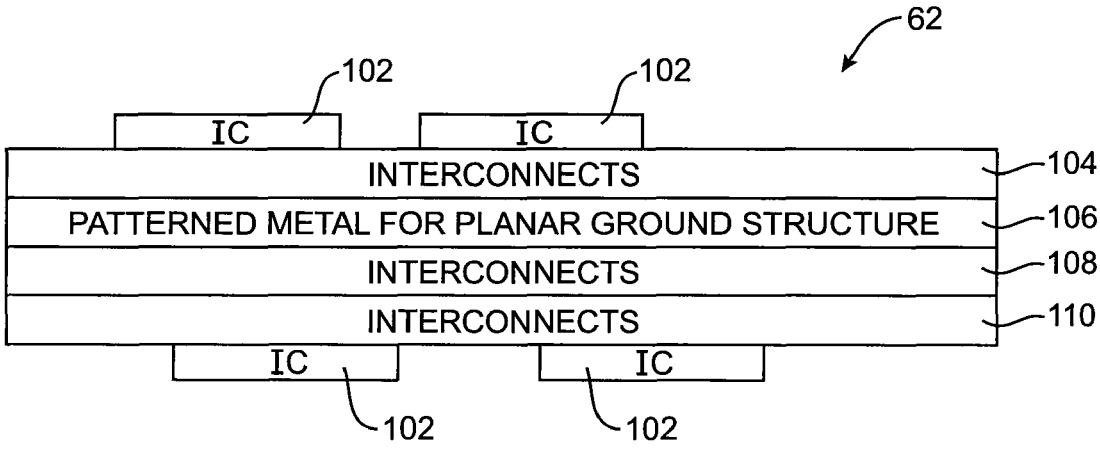
FIG. 11 is a cross-sectional side view of an illustrative printed circuit board that may be used in a compact portable wireless device with an antenna in accordance with an embodiment of the present invention.

A cross-sectional side view of an illustrative printed circuit board 62 is shown in FIG. 11. As shown in FIG. 11, printed circuit board 62 may have four layers 104, 106, 108, and 110. In general, printed circuit board 62 may have any suitable number of layers. The four-layer printed circuit board arrangement shown in FIG. 11 is merely illustrative. Integrated circuits 102 and other electrical components (e.g., components such as resistors, capacitors, and inductors, oscillators, antenna elements, terminals for battery wires, terminals for piezoelectric sensor wires, switches, and other devices) may be mounted to the upper and lower surfaces of printed circuit board 62. Integrated circuits 102 may include processing circuits, such as microprocessors, radio-frequency transmitter and receiver circuits (e.g., transceiver circuits having positive and negative terminals for connecting to the feed and ground of antenna 100), memory, custom integrated circuits, and other suitable integrated circuits. Each layer of printed circuit board 62 may contain patterned conductors. Vias may be used to connect the conductive elements on layers 104, 106, 108, and 110 together.

In some layers (e.g., layers 104, 108, and 110 of FIG. 11), the patterned conductors form interconnect structures. The interconnects in these layers are used to interconnect the electrical components that are mounted on the printed circuit board 62. Suitable materials for the conductors in printed circuit board 62 include copper and other metals, etc.

In at least one layer (e.g., layer 106 in printed circuit board 62 of FIG. 11), the patterned conductor is used to form the planar ground structure for antenna of compact wireless device 12. This is accomplished by forming a solid or nearly solid pattern of conductor in layer 106 (in the FIG. 11 example). If desired, the planar ground structure for the antenna may be formed by forming solid or nearly solid patterns of conductor in multiple layers (e.g., layers two and three) of printed circuit board 62.

The planar ground structure need not occupy all of the available area in layer 106. For example, the planar ground structure in printed circuit board 62 may be formed using patterns of conductor in layer 106 that are separated by gaps. So long as there is a sufficient amount of conductive material covering layer 106, layer 106 will act as a planar ground structure. As an example, layer 106 may be patterned so that 70% or more of the area of printed circuit board 62 is covered with conductor, so that 80% or more is covered, so that 90% or more is covered, or so that any other suitable amount of the surface area of layer 106 is covered with conductor. Other suitable coverage amounts may be used in forming the antenna ground structure if desired.

In a typical arrangement, at least some of the area in layer 106 (or other layers in printed circuit board 62 that are being used to form planar ground structure 62) is left uncovered by conductor to accommodate mechanical and electrical structures in device 12. For example, portions of layer 106 may be left uncovered to accommodate screws 72, portions of layer 106 may be left uncovered to avoid forming electrical connections between the antenna ground structure and other portions of the antenna, etc. The example of FIG. 11 involves an arrangement in which the planar ground structure for the antenna is formed from circuit board layer 106. If desired, the planar ground structure may be formed from another layer (e.g., layer 104, layer 108, or layer 110) or multiple layers.

Figure 12:
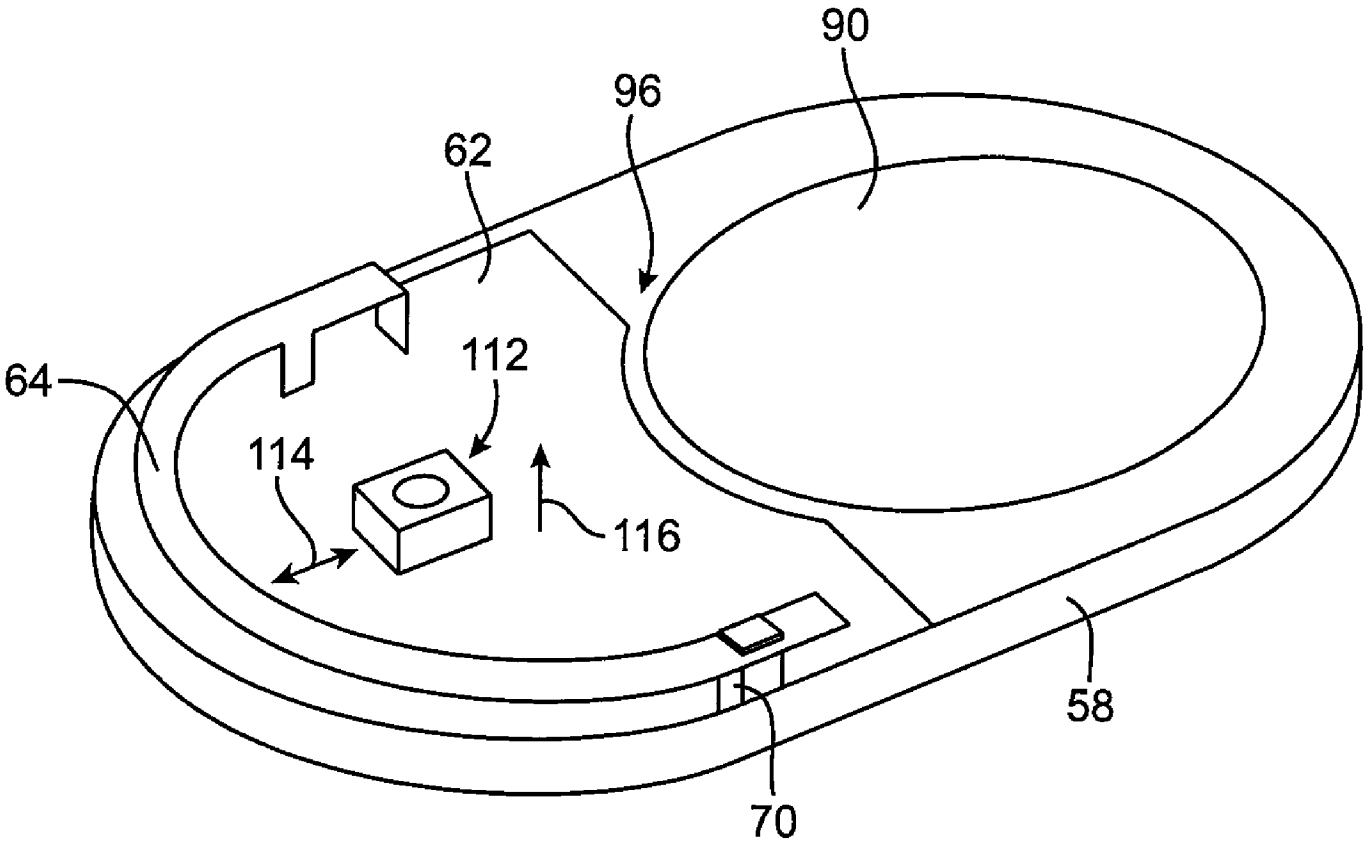
FIG. 12 is a perspective view of an illustrative compact portable wireless device having an illustrative antenna resonating element main structure formed from a semicircular conductive strip that is configured to reside at a distance from circuit components that protrude upwards from central portions of a printed circuit board in accordance with an embodiment of the present invention.

Compact portable wireless device 12 may have electrical components such as switches. A perspective view of a portion of an illustrative compact portable wireless device 12 that has a switch 112 is shown in FIG. 12. Switch 112 may be, as an example, a reset switch.

As shown in FIG. 12, switch 112 may be mounted to printed circuit board 62. A portion of switch 112 protrudes vertically from the surface of printed circuit board 62 in direction 116. Because of the relatively large height of switch 112, switch 112 and antenna resonating element 64 may have the same or nearly the same vertical separation from ground plane structure 62. As a result, it is generally desirable to space switch 112 and the main strip structure of resonating element 64 far apart in horizontal dimension 114. Providing sufficient lateral separation between resonating element 64 and tall electrical components such as switch 112 helps to ensure that radio-frequency interference between the electrical components on board 62 and resonating element 64 are minimized. Short components (e.g., components that lie close to the surface of printed circuit board 62), can, if desired, be placed directly under resonating element 64. In general, however, it is desirable to maximize the separation between resonating element 64 and the electrical components on printed circuit board 62 as much as possible, within the available real estate of board 62.

In conventional antenna arrangements such as planer inverted-F antenna arrangements, the resonating element occupies a large planar area. Because such a large planar resonating element area would overhang a large portion of the ground structure, use of a conventional planar inverted F structure in compact wireless device 12 would provide little or no breathing room for underlying electrical components on the printed circuit board.

Figure 13:
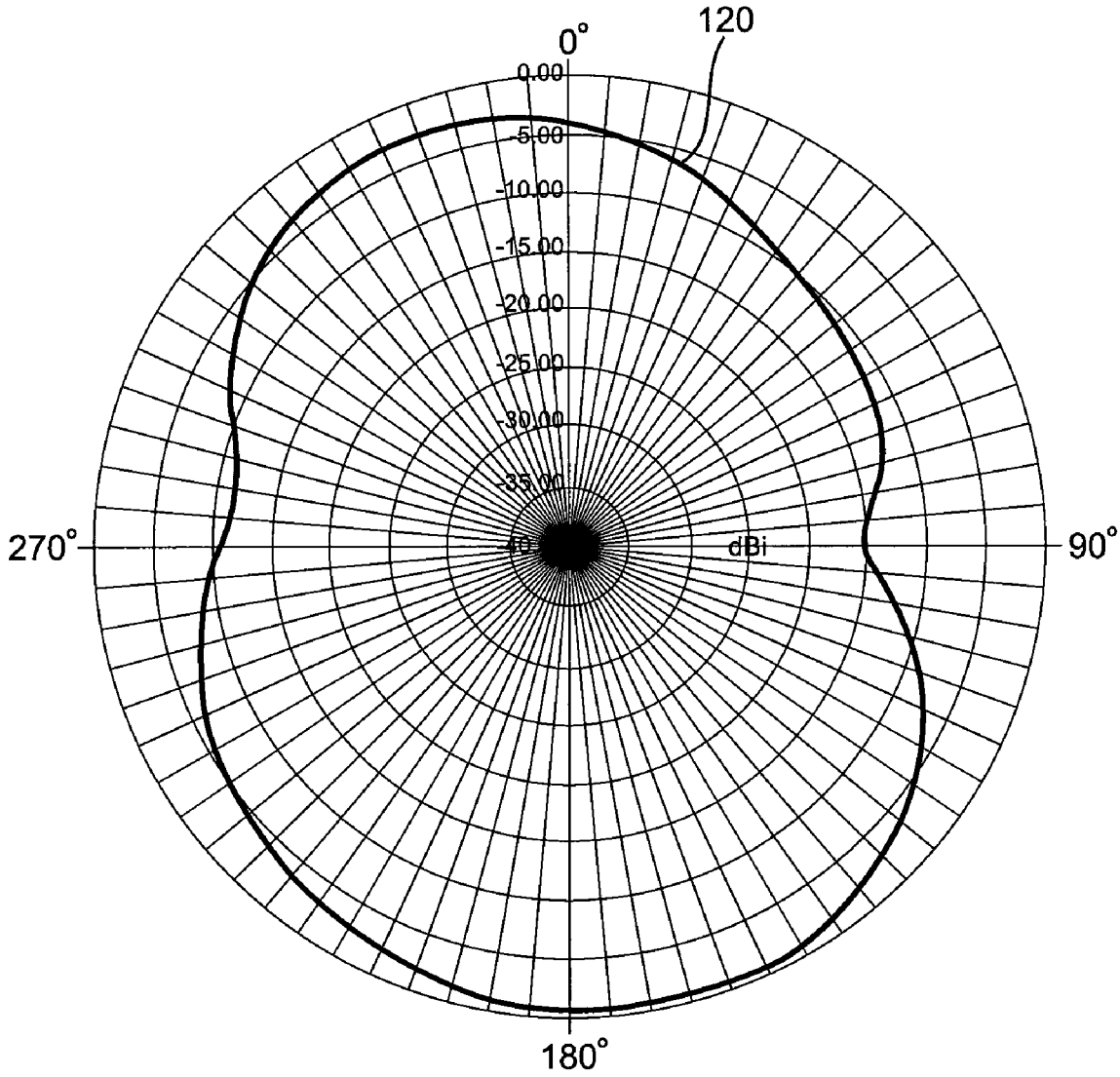
FIG. 13 is a graph of a measured radiation pattern for a compact portable wireless device with an antenna in accordance with an embodiment of the present invention.

The amount of radio-frequency radiation that the antenna of compact portable wireless device 12 of FIGS. 9 and 10 emits has been measured as a function of angle about longitudinal axis 118 of device 12 (FIGS. 9 and 10). These measurement results are plotted in the graph of FIG. 13 as a function of angular position around longitudinal axis 118. As shown in FIG. 13, line 120 is nearly circular, as would be the situation for an ideal dipole. The average efficiency of the antenna is about 40%, which is relatively high for a compact antenna design. High efficiency helps to conserve battery power during wireless transmit and receive operations. Because battery power is conserved, the size of battery 90 and therefore compact portable wireless device 12 may be minimized.

Figure 14:
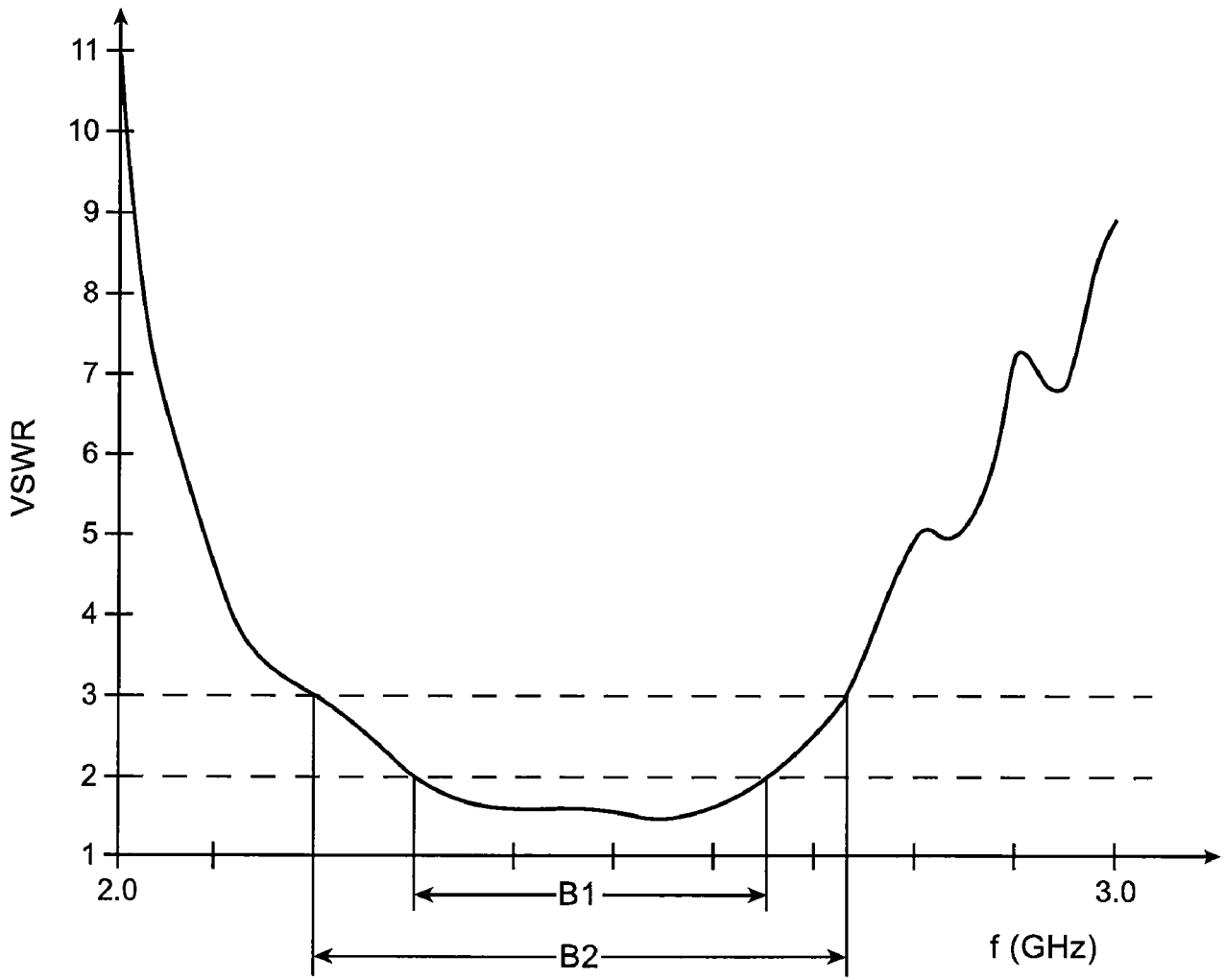
FIG. 14 is a graph in which the measured voltage standing wave ratio of a compact portable wireless device antenna in accordance with an embodiment of the present invention has been plotted as a function of frequency.

Antenna designs of the type shown in FIGS. 9 and 10 have been further characterized by measuring voltage standing wave ratios. An illustrative measured voltage standing wave ratio (VSWR) graph is shown in FIG. 14. In the graph of FIG. 14, the antenna's VSWR has been plotted as a function of signal frequency over an illustrative range of frequencies extending from 2.0 GHz to 3.0 GHz. In general, the antenna of the compact portable wireless device 12 may operate over any suitable frequency range. The frequencies for which antenna performance was measured in the graph of FIG. 14 are merely illustrative.

As shown in FIG. 14, compact portable wireless device 12 can operate over a relatively wide frequency range, even though the dimensions of resonating element 64 and antenna 100 are relatively small. In particular, the antenna of compact portable wireless device 12 is characterized by a 2:1 VSWR bandwidth (B1) of about 0.35 GHz (2.3 GHz to 2.65 GHz) and a 3:1 VSWR bandwidth (B2) of about 0.53 GHz (2.2 GHz to 2.73 GHz).

The large efficiency and bandwidth of the antenna of compact portable wireless device is due at least partly to the presence of parasitic antenna element 90. Element 90, which is separated from printed circuit board 62 by gap 76 may be relatively close in size and shape to the planar ground structure on printed circuit board 62. Parasitic element 90 and the planar ground structure of board 62 may resonate in a way that adds to the efficiency and bandwidth of the antenna formed by ground plane 62 and resonating element 64. When operated together, resonating element 64, the planar ground structure of printed circuit board 62, and parasitic element 90, exhibit a high efficiency and wide operating range.

The relatively wide operating frequency range of the antenna helps to ensure that the wireless communications capabilities of compact portable wireless device 12 are relatively insensitive to changes in the operating environment of compact portable wireless device 12. This allows compact wireless device 12 to be used in sports equipment and other equipment in which the wireless environment of device 12 is somewhat unpredictable. For example, compact portable wireless device 12 may be able to communicate effectively with portable electronic device 18, regardless of whether the center frequency of the antenna has been detuned due to the presence of a human foot in shoe 14 of FIG. 2 or is being operated when not in the presence of a human foot.

The foregoing is merely illustrative of the principles of this invention and various modifications can be made by those skilled in the art without departing from the scope and spirit of the invention.

What is claimed is:

1. A compact portable wireless device that transmits wireless data from within an athletic shoe to a handheld electronic device, comprising:

an antenna comprising an F-shaped resonating element having a feed arm, a ground arm, and a main structure, a planar ground structure to which the ground arm of the F-shaped resonating element is connected, and a planar parasitic element that is separated from the planar ground structure by a gap and that is near-field coupled to the planar ground structure;

a sensor that senses footsteps when a runner is running while wearing the shoe; and circuitry that transmits signals from the sensor through the antenna.

2. The compact portable wireless device defined in claim 1 wherein the planar parasitic element comprises a disc-shaped battery that has a metal case.

3. The compact portable wireless device defined in claim 1 further comprising a printed circuit board, wherein at least one switch is mounted to the printed circuit board, wherein the planar ground structure is formed from conductor on the printed circuit board, and wherein the main structure of the F-shaped resonating element follows an edge of the printed circuit board to maximize separation between the switch and the main structure of the F-shaped resonating element.

4. The compact portable wireless device defined in claim 1 further comprising a plastic housing and a printed circuit board mounted within the plastic housing, wherein:

the printed circuit board has a curved edge; and the planar parasitic element comprises a disc-shaped battery that has a metal case, wherein the metal case has a curved edge that matches the curved edge of the printed circuit board.

5. The compact portable wireless device defined in claim 1 further comprising a plastic housing and a printed circuit board mounted within the plastic housing, wherein:

the planar ground structure is formed from the printed circuit board;

the printed circuit board has a first curved edge and a second curved edge; and the planar parasitic element comprises a disc-shaped battery that has a metal case, wherein the metal case has a curved edge that matches the first curved edge of the printed circuit board, and wherein the main structure of the resonating element has a curve that matches the second curved edge of the printed circuit board.

6. The compact portable wireless device defined in claim 1 wherein the planar parasitic element has a curved edge along the gap.

7. The compact portable wireless device defined in claim 1 wherein the planar parasitic element and the planar ground structure planar ground structure lie in a common plane.

* * * * *